United States Patent [19]

Finch et al.

[11] Patent Number: 5,044,102

[45] Date of Patent: Sep. 3, 1991

[54] TENSIONED DISPLAY SIGN HAVING HINGED FRAME SECTION

[75] Inventors: W. Dennis Finch, Mustang, Okla.; Jack W. Snyder, Wichita, Kans.

[73] Assignee: Graphic Structures, Inc., Oklahoma City, Okla.

[21] Appl. No.: 440,643

[22] Filed: Nov. 20, 1989

[51] Int. Cl.[5] ..... G09F 17/00

[52] U.S. Cl. ..... 40/603; 40/574; 160/378

[58] Field of Search ..... 40/603, 156, 624, 574; 160/368.1, 378, 368.2, 378, 329, 375, 376, 379

[56] References Cited

U.S. PATENT DOCUMENTS

| | | | |
|---|---|---|---|
| 229,010 | 6/1880 | Ratcliff | 160/375 |
| 1,844,967 | 2/1932 | LeGore | 160/375 |
| 2,645,540 | 7/1953 | Trimble et al. | 160/378 |
| 3,748,455 | 7/1973 | Welton | 40/574 |
| 4,317,302 | 3/1982 | Von De Linde | 40/603 |
| 4,424,637 | 1/1984 | Leahy | 40/152 |
| 4,674,214 | 6/1987 | Gandy | 40/156 |
| 4,773,174 | 9/1988 | Boeniger et al. | 40/603 |

OTHER PUBLICATIONS

Oz, "Simply Brilliant!" brochure, published 12/1987.

*Primary Examiner*—Kenneth J. Dorner
*Assistant Examiner*—James M. Gardner
*Attorney, Agent, or Firm*—Kokjer, Kircher, Bradley, Wharton, Bowman & Johnson

[57] ABSTRACT

A sign which includes a sign cabinet having a rigid frame on which a flexible vinyl sign face is stretched. The sign face has hems on its top and bottom edges. Rigid rods are inserted in the hems, and tension springs are extended through notches in the hems and hooked to the rods. The other ends of the springs are hooked on lips projecting from extrusions which extend along the top and bottom of the face frame. The springs hold the sign face taut on the sign cabinet frame. A special hinged end section is pivoted on the frame to permit the sign face to be placed under the proper lateral tension as a result of the lever action resulting from swinging the hinged section inwardly and then bolting it in place on the sign cabinet frame.

11 Claims, 3 Drawing Sheets

TENSIONED DISPLAY SIGN HAVING HINGED FRAME SECTION

BACKGROUND OF THE INVENTION

This invention relates generally to the construction of signs and more particularly to relatively large signs of the type that are formed by a flexible vinyl sign face which is drawn over and secured to a sign cabinet.

In recent years, large signs having flexible vinyl faces have been introduced and have achieved considerable popularity. Signs that are constructed with flexible face material are advantageous in several respects, most notably because they allow the sign to be constructed with a single piece face in much larger sizes than is possible with rigid face signs.

However, flexible vinyl faces present problems of their own, principally because it is difficult to achieve proper tensioning of the face material. In order to prevent the sign face from becoming unsightly due to wrinkling and/or sagging, it is necessary to stretch the sign face tautly on its frame. One way this has been done is to stretch the face on the frame in the factory and then fold or collapse the frame in accordion fashion for shipment to the job site. At the site, the frame is unfolded and secured in a rigid position on the ground and then lifted as a single flat panel and installed on the sign cabinet. This type of system is not practical for signs that are particularly long. Another major problem is that two boom trucks are required to lift the sign panel if the sign is large (over 45 feet long), and a number of workers are required to stabilize the face during installation. Because the face has a relatively lightweight frame and a large surface area, installation in windy conditions is impossible. If the face is installed at the factory, it is always possible that it will lose tautness during shipping, handling or installation. Furthermore, after the face has been installed, it is subjected to exposure to the elements which can cause it to become loose and unsightly.

Additional difficulties are encountered with systems that are designed for field installation of the flexible face. This type of system requires some type of tensioning mechanism that allows the sign face to be stretched and held in the proper tension both horizontally and vertically. Achieving the proper tension in this type of system relies on the "feel" of the worker or workers who make the installation, and poorly tensioned sign faces often result. Stripes and other graphic patterns can appear crooked or otherwise distorted if the face is too loose or maintained under more tension in some areas than in other areas.

SUMMARY OF THE INVENTION

The present invention is directed to a flexible face sign that eliminates the foregoing problems. It is the principal goal of the invention to provide a flexible face sign that can be efficiently installed in the field with the sign face maintained under a constant tension that is proper for the particular application of the sign.

In accordance with the invention, a flexible sign face is cut to the dimensions required for the sign cabinet on which it is to be installed. The top and bottom edges of the face are hemmed, and the hems are notched at factory selected locations. The face can then be rolled up and boxed for shipment to the job site. At the job site, the cabinet frame is assembled, and the face is attached at one end to one end of the cabinet. The face is then unrolled in increments to permit metal rods to be inserted into the hems. Tension springs are hooked at one end through the hem notches and onto the rods along both the top and bottom edges of the sign face. The opposite ends of the springs are hooked onto lips which are formed on extrusions that form the top and bottom horizontal frame members of the sign cabinet. In this manner, the springs apply tension to the sign face which keeps it stretched tightly between the top and bottom members of the frame.

It is a particular feature of the invention that the frame is equipped with a hinged section that facilitates lateral tensioning of the sign face. The hinge section can be swung outwardly to permit the free end of the face sheet to be connected to it with the face in a slack condition. When the hinged section is then swung back into alignment with the cabinet frame and bolted in place, the face is pulled laterally to a taut condition.

By virtue of this construction of the sign, the optimum tension of the sign face can be determined at the factory for each application, depending principally on the length and height of the sign face and the type of vinyl material that is employed. Because each springs applies a known force, the hem notches can be factory cut at strategically selected locations that will result in the proper overall tension when one spring is hooked through each notch. Consequently, proper tension of the sign face is assured and the springs automatically take up any slack that later develops in the sign face due to wind forces, varying temperatures, or the impact of objects against the sign face. The tension forces that are applied at the top and the bottom of the sign face by the springs are equal, and the sign face thus remains automatically centered on the sign cabinet.

Savings in the shipping costs are achieved because even extremely long faces can be rolled up and shipped in relatively small shipping boxes. Signs 150 feet long or more can be installed by two men even in windy conditions and without the need for cranes or other expensive equipment. Each sign can be custom made to whatever size and sign configuration is desired.

DESCRIPTION OF THE DRAWINGS

In the accompanying drawings which form a part of the specification and are to be read in conjunction therewith and in which like reference numerals are used to indicate like parts in the views.

DETAILED DESCRIPTION OF THE INVENTION

Figure 1:
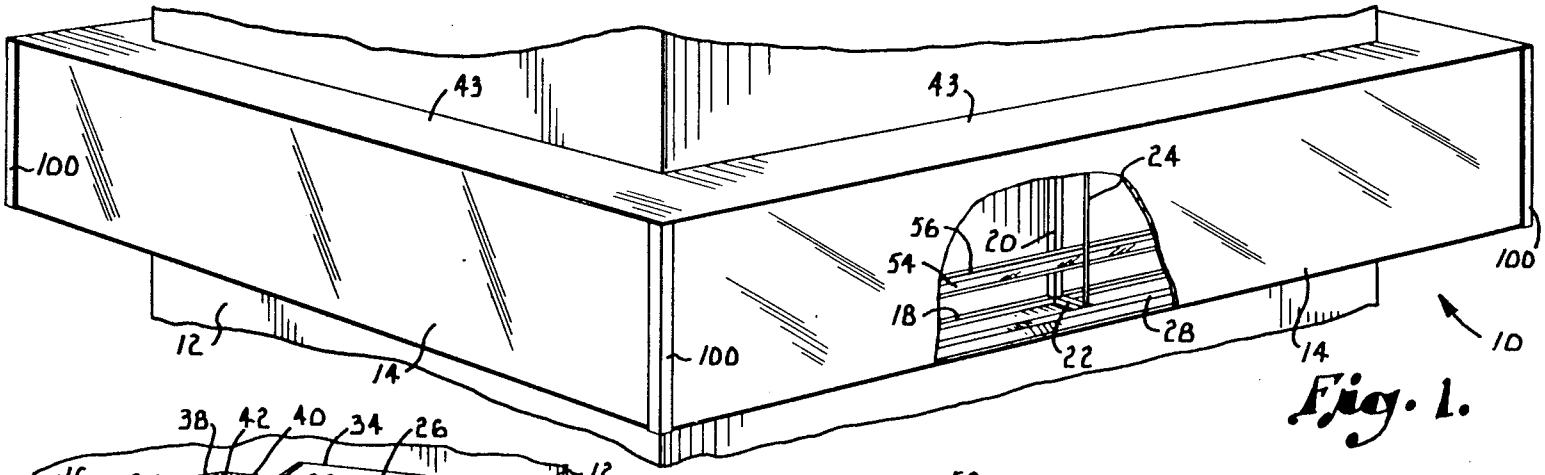
FIG. 1 is a fragmentary perspective view of a sign constructed in accordance with the present invention installed on a building structure, with a portion of the flexible sign face broken away for purposes of illustration.

Referring now to the drawings in more detail and initially to FIG. 1, numeral 10 generally designates a sign which is constructed in accordance with the present invention. The sign 10 is shown as being installed in extension around a building structure 12 which may be the type of structure commonly forming part of an island in a gasoline service station. The sign 10 extends completely around the building structure 12 and is installed at an elevated position. However, it should be understood that the sign of the present invention can be used in other applications, and it should also be noted that the sign can have configurations and sizes different from what is shown in FIG. 1. For example, the sign can be a single faced sign or have virtually any number of faces, it can be free standing or wall mounted, it can be illuminated or not illuminated, and it can have faces that are flat as shown in FIG. 1 or another shape as will be described in connection with FIG. 5.

The sign has a rigid frame which is constructed of a plurality of interconnected frame members and which forms a sign cabinet on which one or more flexible vinyl faces 14 are installed. On each side of the sign cabinet the frame includes a pair of horizontal members 16 and 18 spaced one above the other at the top and bottom on the back portion of the frame. The top and bottom members 16 and 18 are connected at intervals along their length by upright posts 20. At the location of each post 20, relatively short horizontal frame members 22 extend forwardly from the top and bottom members 16 and 18. Members 16, 18, 20 and 22 may be square tubes that are preferably constructed of aluminum. Vertical rods 24 extend between each pair of upper and lower members 22 near their forward ends. The frame members 16, 18 and 20 can be secured to the walls of the building 12 in any suitable manner.

Figure 2:
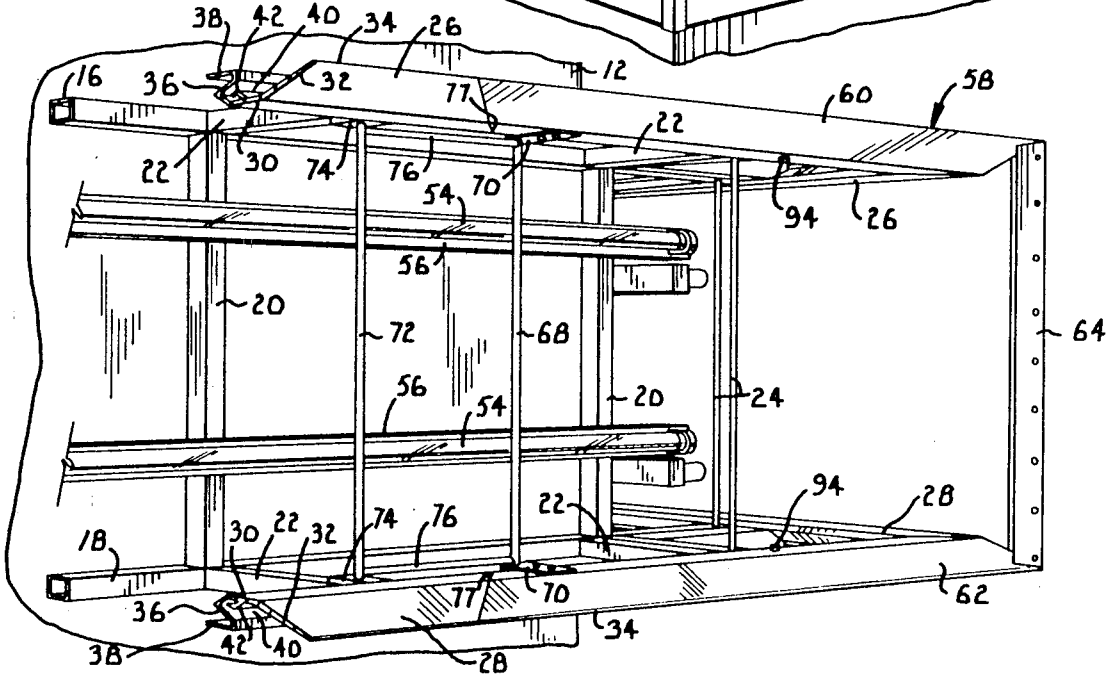
FIG. 2 is a fragmentary perspective view on an enlarged scale showing one corner area of the sign, with the flexible sign face and the top and bottom cover panels removed from the sign cabinet frame.

On the front or outer portion of the cabinet frame, the top and bottom members on each side of the cabinet are formed by rigid aluminum extrusions 26 and 28, respectively. Extrusions 26 and 28 extend horizontally and are secured to the forward ends of members 22. Each of the extrusions 26 and 28 is constructed in the same manner. With particular reference to FIG. 2, each extrusion includes a flat base 30 and an inclined wall 32 which extends from the front edge of the base 30 and terminates in a rounded front edge 34. Each extrusion 26 and 28 has a bent back wall section 36 and a rearwardly turned flange 38 having a horizontal orientation.

Each extrusion 26 and 28 has a channel 40 extending along its length and formed between the wall sections 32 and 36. The channel 40 of the upper extrusion 26 is open at the top and is located above the base 30, while the channel 40 of the lower extrusion 28 is open at the bottom and is located below the base 30. A hook shaped lip 42 projects from the base 30 of each extrusion into the channel with the hook projecting somewhat to the rear.

The channel 40 of the top extrusion 26 is closed by a top cover panel 43 which overlies the top frame member 16 and the flange 38 of the top extrusion. The front edge 44 of cover panel 43 is folded under itself to present an attractive finished appearance. The edge 44 is located immediately above the rounded edge 34. A screw 46 (see FIG. 4) or other fastener is used to secure panel 43 to flange 38.

The channel 40 in the bottom extrusion 28 is similarly closed at the bottom by a bottom cover panel 48. Panel 48 immediately underlies the bottom frame member 18 and the flange 38 of the lower extrusion. Panel 48 has a folded front edge 50 which is located immediately beneath the rounded edge 34 of the bottom extrusion 28. Panel 48 is secured in place by screws 52 (FIG. 4) which connect it with the flange 38.

If the sign is an illuminated sign, one or more lamps 54 are mounted on lamp holders 56 which are suitable secured to the back posts 20. The lamps 54 preferably extend horizontally one above the other within each side of the sign cabinet, and suitable wiring is provided to supply electricity for energizing the lamps.

Each side of the sign cabinet can be assembled in virtually any length by bolting a number of frame sections end to end to provide the desired length. The cabinet frame sections may be provided in standard lengths (15 feet long, for example). By bolting three standard frame cabinets end to end, an overall cabinet length of 45 feet can be provided. Custom formed cabinet frame sections having any desired length can also be provided and bolted end to end with standard cabinets so that whatever overall cabinet side length is desired can be achieved. The cabinet frame can be of any desired height.

Figures 3, 6:
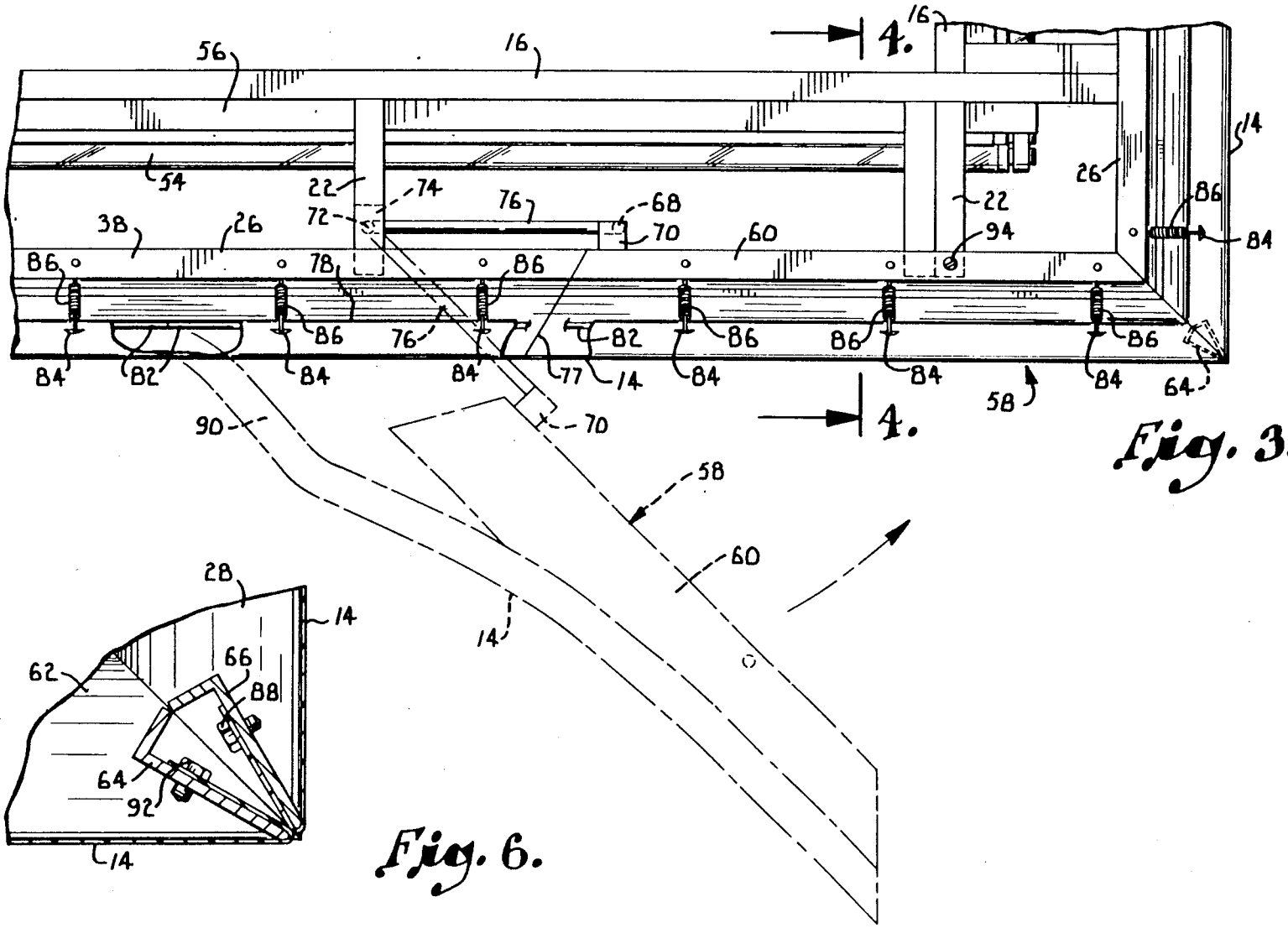
FIG. 3 is a fragmentary top plan view of the corner area of the sign shown in FIG. 2, with portions broken away for purposes of illustration and the broken lines illustrating the position of the hinged frame section prior to final installation of the sign face.
FIG. 6 is a fragmentary sectional view on an enlarged scale taken on a horizontal plane through one corner of the sign.
Figure 4:
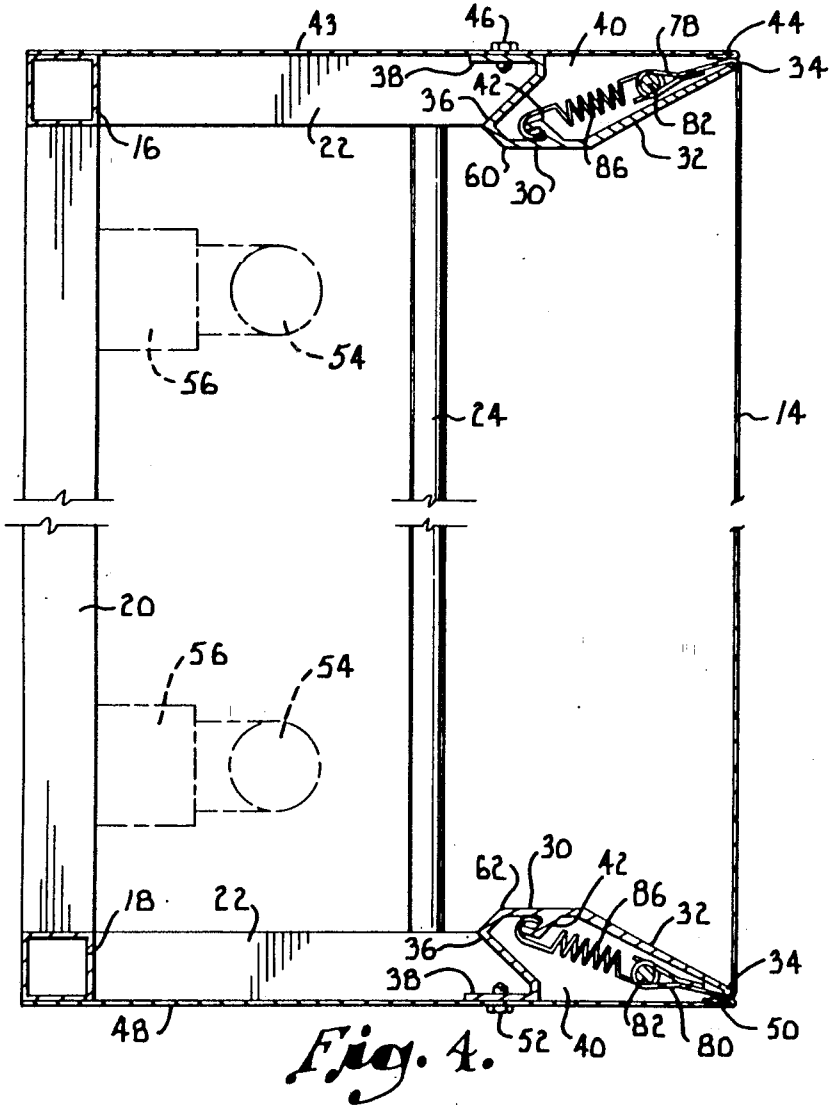
FIG. 4 is a fragmentary sectional view on an enlarged scale taken generally along line 4—4 of FIG. 3 in the direction of the arrows, with the break lines indicating continuous length.

A special hinged frame section which is generally identified by reference numeral 58 in FIGS. 2 and 3 is mounted on one end of each side of the cabinet frame (the right end as viewed from the front). The special hinged section 58 includes top and bottom extrusions 60 and 62 which have configurations identical to extrusions 26 and 28 (as best shown in FIG. 4). Extrusions 60 and 62 form extensions or continuations of the respective extrusions 26 and 28 when the hinged section 58 is swung inwardly to the position shown in FIG. 2 and in solid lines in FIG. 3. An end member of the hinged section 58 is formed by an upright aluminum angle member 64 which extends between the top and bottom extrusions 60 and 62 at one end (the corner of the sign). As best shown in FIG. 6, the angle member 64 butts up against a similar but opposing angle member 66 formed on the adjacent side of the sign cabinet at the corner. The extrusions 60 and 62 are connected near their other ends by a vertical rod 68 which connects with steel straps 70 screwed to the bases 30 of the extrusions 60 and 62.

The hinged frame section 58 is mounted for pivotal movement about a vertical hinge axis provided by a vertical rod 72. The top and bottom ends of rod 72 fit loosely in openings formed in aluminum bars 74 which are suitably secured to frame members 22 near their front ends. The rod 72 is located a short distance behind the extrusions 26 and 28. Rod 72 is able to turn relative to the bars 74 and is connected rigidly with rod 68 by horizontal rods 76. Rods 76 are secured to the vertical rods 68 and 72 near their upper and lower ends. Consequently, the hinged frame section 58 can pivot about the axis of rod 72 between the position shown in solid lines in FIGS. 2 and 3 and the position shown in broken lines in FIG. 3. In the first position, section 58 is in alignment with the remainder of the cabinet frame and serves as part of the frame. Extrusions 26 and 28 have angled ends that meet similarly angled ends of extrusions 60 and 62 at angled joints 77 which are angled at about 30° from an orientation perpendicular to the length of the extrusions. In the broken line position of FIG. 3, section 58 is pivoted outwardly for a purpose that will be described more fully.

The flexible sign facing 14 is constructed of a suitable vinyl material and has a length and height suitable for the cabinet frame on which it is to be installed. As best shown in FIGS. 3 and 4, the upper and lower edges of sheet 14 are provided with hems identified by numerals 78 and 80, respectively. Each of the hems 78 and 80 extends the entire length of the sign face 14, and the hems may be secured by stitching or heat seals.

Rigid aluminum rods 82 are fitted in each hem 78 and 80 end to end and occupy substantially the entire length of each hem. By way of example, each rod 82 may have a diameter of approximately ¼ inch and a length of approximately 10 feet.

As best shown in FIG. 3 for the upper hem 78, each hem 78 and 80 is provided with a plurality of notches 84 which are preferably spaced uniformly apart from one another at strategic locations spaced along the entire length of the sheet 14. A plurality of tension springs 86 are used to apply tension forces to the facing sheet 14. One set of springs 86 acts on the upper edge of sheet 14 and another set of springs 86 acts on the lower edge of sheet 14.

One spring 86 is inserted through each notch 84 in the top hem 78 and is hooked around the corresponding aluminum rod 82. The opposite end of the spring is hooked on the lip 42 formed within the channel 40 of the upper extrusion 26. Similarly, one spring is extended through each notch 84 in the lower hem 80 and is hooked around the aluminum rod 82 in the hem. The opposite end of the spring is hooked on the lip 42 of the lower extrusion 28.

The sign 10 is constructed by first determining the number of frame sections that are required in order to provide the proper length for the sign cabinet. Then, at the factory, the vinyl material of which the flexible face 14 is formed is cut to the dimensions that are required for the sign cabinet. The top and bottom hems 78 and 80 are sewn or heat sealed and the notches 84 are cut in the hems at intervals that are determined by the amount of tension that is necessary for the particular application of the sign. Typically, the face 14 will be predecorated with whatever pattern is to be displayed by the sign. The face 14 can be rolled up and shipped in a relatively small box to the job site, along with the frame sections.

At the job site, the frame sections are installed on the building 12 end to end to form a continuous cabinet frame on each side of the sign 10. The frame members can be suitably secured to the walls of building 12. It is noted that installation of the frame sections can be carried out by only two men, since each section is small enough and light enough to be handled by two workers. Preferably, the frame of the sign cabinet is constructed of aluminum because of its strength, light weight and corrosion resistance.

The sign face 14 is installed on each side of the sign cabinet by first attaching one end of the face to a corresponding end of the sign cabinet frame. This is accomplished by drawing the end of the face 14 around the end member 66 which is located at the end opposite the hinged frame section 58. Screws 88 (see FIG. 6) may be used to attach the end of the sign face 14 to member 66.

The face 14 is then partially unrolled in an initial increment about twelve feet long. One of the rods 82 is inserted into each of the hems 78 and 80. Working progressively from the attached end of the facing, the springs 86 are then installed one at a time by hooking each spring 86 over the lip 42 and pulling it so that its opposite end can be inserted through the corresponding notch 84 and hooked onto the aluminum rod 82 which is located in the hem 78 or 80. A special tool (not shown) may be used to stretch the springs 86 and hook them onto the rods 82.

The springs 86 are installed in this manner at the top and bottom of the face 14 at each location where one of the notches 84 is formed. When the end of each ten foot long rod 82 is reached, the face 14 is unrolled by an additional ten feet, and two more of the rods 82 are installed in the hems 78 and 80. The installation process continues in this fashion until a location approximately four feet from the end of the frame side is reached, at which time the final horizontal tensioning of the face 14 is carried out through use of the hinged frame section 58.

With the frame section 58 swung to the closed position shown in FIG. 2, the face 14 is extended by hand in a taut manner beyond the end angle member 64. A mark is then placed flush with the angle member 64, and the hinged section 58 is swung to the broken line position of FIG. 3. This permits the face 14 to be attached to the hinged section 58 while the face presents approximately six to ten inches of slack, as indicated at 90 in FIG. 3.

In order to assure that the face 14 will be fully taut from side to side when finally installed, approximately 1/32 inch should be subtracted from the mark on the sign face for each lineal foot of the sign face. For example, if the sign face is 32 feet long, a second mark should be made on the face 14 approximately one inch to the left of the initial mark. The face 14 is then attached to the end angle member 64 with the new mark in alignment with the outer edge of member 64. Screws 92 (see FIG. 6) may be used to attach the end portion of the face 14 with the angle member 64. Any excess length of the face can be trimmed off with a knife or other cutting tool.

Next, the hinged section is swung slowly inwardly toward the position shown in FIG. 2. As the hinged section 58 is pivoted about the axis of rod 72, it exerts lever action on the face 14 and stretches it laterally to the proper tension. Once the hinged section 58 has been swung inwardly to its final position, it is bolted securely in place by bolts 94 (see FIGS. 2 and 3) which are extended through the top and bottom extrusions 60 and through the adjacent frame members 22 at the top and bottom of the frame. This secures the hinged section 58 in its final position and allows it to function as a rigid part of the sign cabinet frame. It is noted that the angled joints between the extrusions and the location of the pivot rod 72 offset from alignment with the extrusions 26 and 28 allow the hinged section 58 to swing in and out in a smooth fashion.

Once the sign face 14 has been laterally drawn to the proper tension in this manner, additional springs 86 are installed to apply vertical tension forces to the portion of the face 14 which is stretched between the extrusions 60 and 62 of the hinged frame section 58. The top and bottom cover panels 43 and 48 can then be installed and screwed in place. The face 14 on each side of the frame is installed in a similar manner, and corner trim pieces 100 (see FIG. 1) can be added if desired once installation of the face 14 has been completed on each side of the sign cabinet frame.

Each of the springs 86 applies a known tension force, and the overall tension force that is applied to the face 14 can be predetermined at the factory, so that the notches 84 can be cut at the locations necessary for the springs to properly tension the sign face 14. The optimum tension depends upon factors such as the height and length of the sign and the type of vinyl material used for the face 14. It is only necessary for the workers installing the sign at the job site to install one of the springs 86 for each notch 84 and the factory selected tension on the face 14 will be assured. Because the springs 86 are connected in pairs at the top and bottom of the sign face 14, the face 14 is automatically centered properly, and the graphics are likewise automatically centered and remain straight due to the tension applied by the springs 86.

It is particularly noteworthy that any slack in the sign face 14 that may be created by varying temperatures, wind forces, or the forces of objects which may strike the sign face is automatically taken up by the springs 86. Consequently, the face 14 is maintained in a taut condition virtually indefinitely. The springs 86 are enclosed in the closed channels 40 and thus are protected from the elements and located out of sight.

Figure 5:
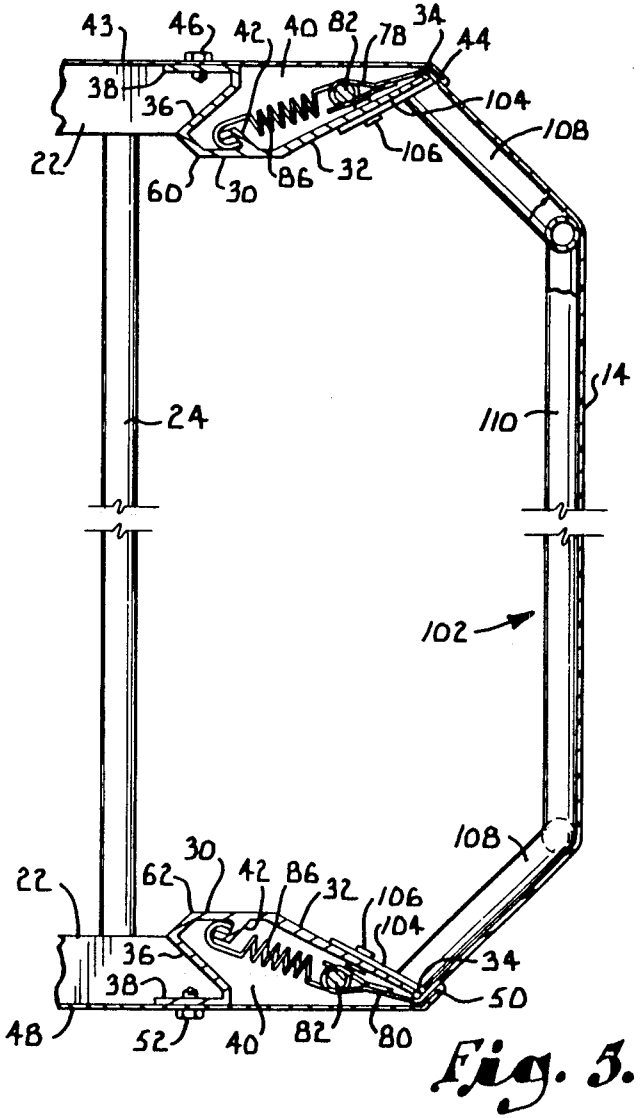
FIG. 5 is a fragmentary sectional view similar to FIG. 4, but showing a modified sign constructed according to another embodiment of the invention.

FIG. 5 is illustrative of variations that can be provided in the configuration of the sign face 14 in accordance with the present invention. The configuration depicted in FIG. 5 is identical to the configuration shown in FIG. 4, except that a metal grill which is generally identified by numeral 102 is mounted on the front of the sign cabinet in order to provide the sign with an appearance similar to that of an awning. The grill 102 has flat bases 104 that may be secured to the inclined walls 32 of the top and bottom extrusions 26 and 28 by suitable fasteners 106. Extending from the bases 104 at the top and bottom are rigid tubes 108 that incline outwardly from the bases. A vertical tube 110 extends rigidly between the outer ends of the inclined tubes 108. Sets of the connected tubes 108 and 110 may be spaced apart along the length of the sign cabinet. The sign face 14 is stretched tautly by the tensioning system along the surface configuration provided by the tubes 108 and 110, and the face 14 thus provides an awning type look. The installation procedure is the same as previously described. The folded edges 44 and 50 of the top and bottom cover panels 42 and 48 may be angled somewhat in the manner shown in FIG. 5.

By virtue of the manner in which the sign 10 is constructed, it can be installed in virtually length with a single piece face 14. Installation requires only two workers and no special equipment such as cranes or boom trucks, and installation can be carried out even in windy conditions because of the gradual manner in which the sign face 14 can be unrolled and installed. The configuration of the face 14 can be varied as desired by installing specially shaped frame members such as the grill 102 or a different type of frame that provides the face with the desired shape when stretched tautly over the frame.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. Display apparatus comprising:

a sign cabinet having a rigid frame comprising a plurality of interconnected frame members and including generally horizontal top and bottom members spaced apart from one another;

a flexible sign facing sheet extending between said top and bottom members and having top and bottom edge portions;

a plurality of rigid rods attached to each said edge portion of said facing sheet;

a plurality of tension springs spaced apart from one another along said top and bottom edge portions, each said spring having one end engaging an associated said rod attached to the corresponding edge portion of said facing sheet and an opposite end engaging said frame in a manner to maintain said facing sheet stretched between said top and bottom members in a taut condition;

a hinged frame section mounted on said frame at one end thereof for pivotal movement about a substantially vertical hinge axis between a first position wherein said frame section serves as part of said frame and a second position wherein said frame section is pivotally displaced from said first position;

means for attaching said facing sheet to said frame at an end thereof opposite said one end;

means for connecting said facing sheet to said hinged frame section with said frame section in said second position and with sufficient lateral slack in said facing sheet to effect a taut lateral condition of said facing sheet when said hinged frame section is subsequently pivoted to said first position; and means for securing said hinged frame section in said first position to secure said facing sheet in a taut condition.

2. Apparatus as set forth in claim 1, wherein said hinge axis is spaced from the plane defined by said facing sheet.

3. Apparatus as set forth in claim 2, wherein said top and bottom members are located partially on said hinged frame section and partially on the remainder of said frame and including an angled joint between the part of each said top and bottom member on said hinged frame section and said part of each said top and bottom member on said remainder of said frame when the hinged frame section is in said first position.

4. Display apparatus comprising:

a sign cabinet having a side which includes a frame presenting opposite first and second end portions;

a flexible sign facing sheet having opposite first and second ends and a length to extend in a taut condition between said first and second end portions of said frame;

means for attaching said first end of said facing sheet with said first end portion of said frame;

a hinged frame section having a substantially vertical end member thereon;

means for mounting said hinged frame section on said second end portion of said frame for pivotal movement about a substantially vertical hinge axis between a first position wherein said frame section serves as part of said frame and a second position wherein said frame section is pivotally displaced from said first position thereof;

means for connecting said second end of said facing sheet to said end member while said frame section is in said second position and while said facing sheet is in a slack condition such that said facing sheet is drawn to a taut condition when said frame section is subsequently moved to said first position; and means for securing said hinged frame section in said first position thereof to secure said sign facing sheet in a taut condition.

5. Apparatus as set forth in claim 4, including:

top and bottom members on said frame between which said facing sheet is stretched; and means for applying tension to said facing sheet in a manner to maintain said facing sheet in a taut condition stretched between said top and bottom members.

6. Apparatus as set forth in claim 5, wherein said tension applying means comprises a plurality of tension springs acting between said frame and said facing sheet in a manner to maintain said facing sheet stretched tautly between said top and bottom members.

7. Apparatus as set forth in claim 5, wherein said top and bottom members are located partially on said hinged frame section and partially on the remainder of said frame and including an angled joint between the part of each said top and bottom member on said hinged frame section and the part of each said top and bottom member on the remainder of said frame when said hinged frame section is in said first position.

8. Apparatus as set forth in claim 7, wherein said hinge axis is spaced from the plane defined by said facing sheet.

9. A method of installing a flexible sign facing sheet on a sign cabinet having a side which includes a frame presenting top and bottom members, opposite first and second end portions and a hinged frame section on the second end portion mounted to pivot thereon about a substantially vertical hinge axis, said method comprising the steps of:

attaching one end of the facing sheet with the first end of the frame;

the facing sheet between the top and bottom members of the frame;

applying tension to the facing sheet in a manner to maintain the facing sheet tautly stretched between the top and bottom members of the frame;

locating the hinged frame section in a pivotal position in which the facing sheet can be attached to the hinged frame section with the facing sheet providing lateral slack therein;

attaching the facing sheet to the hinged frame section with the facing sheet having lateral slack therein;

pivoting the hinged frame section about said hinge axis to a position wherein the hinged frame section serves as part of said frame and the facing sheet is drawn to a laterally taut condition; and securing said hinged frame section in the position wherein it serves as part of said frame to secure the facing sheet in a laterally taut condition.

10. The method of claim 9, wherein:

said facing sheet includes upper and lower edges; and said tension applying step comprises attaching one set of tension springs between the upper edge of the facing sheet and the frame and attaching another set of tension springs between the lower edge of the facing sheet and the frame in a manner to maintain the facing sheet tautly stretched between the top and bottom members.

11. The method of claim 10, wherein said tension applying step further comprises;

inserting at least one rigid rod in each hem formed on the upper and lower edges of the facing sheet; and hooking one end of each of the springs to the corresponding rod and the other end of each of the springs to the frame.

* * * * *